United States Patent [19]

Günther et al.

[11] 4,363,744

[45] Dec. 14, 1982

[54] MIXTURES OF OPTICAL BRIGHTENERS AND THEIR USE FOR THE OPTICAL BRIGHTENING

[75] Inventors: Dieter Günther, Kelkheim; Rüdiger Erckel, Eppstein; Günter Rösch, Bad Soden am Taunus; Heinz Probst, Sulzbach, all of Fed. Rep. of Germany

[73] Assignee: Hoechst Aktiengesellschaft, Fed. Rep. of Germany

[21] Appl. No.: 239,454

[22] Filed: Mar. 2, 1981

Related U.S. Application Data

[63] Continuation of Ser. No. 73,938, Sep. 10, 1979, abandoned.

[51] Int. Cl.[3] ..... C09K 11/06; D01P 1/38

[52] U.S. Cl. ..... 252/301.22; 252/301.23; 252/301.24; 252/301.25

[58] Field of Search ..... 252/301.23, 301.24, 252/301.25, 301.22

[56] References Cited

U.S. PATENT DOCUMENTS

| | | | |
|---|---|---|---|
| 3,407,196 | 10/1968 | Liechti et al. | 252/301.24 X |
| 3,669,896 | 6/1972 | Preininger et al. | 252/301.25 X |
| 3,689,481 | 9/1972 | Scheuermann et al. | 252/301.24 X |
| 3,789,012 | 1/1974 | Tuite | 252/301.24 |
| 3,793,340 | 2/1974 | Sarkar | 252/301.24 X |
| 3,843,651 | 10/1974 | Luethi | 252/301.25 X |
| 4,129,412 | 12/1978 | Gunther et al. | 8/1 W |

*Primary Examiner*—F. Edmundson

*Attorney, Agent, or Firm*—Connolly and Hutz

[57] ABSTRACT

Mixtures of optical brighteners consisting of from (a) 0.98 to 0.50 part by weight of a mixture consisting of from 0.05 to 0.95 part by weight of a brightener of the series of the benzoxazolyl-stilbenes and of from 0.95 to 0.05 part by weight of a brightener of the series of the aryltriazoles and (b) of from 0.02 to 0.5 part by weight of a brightener of the series of the bis-benzoxazolyl-stilbenes or of the bis-benzothiazolyl-stilbenes.

4 Claims, No Drawings

MIXTURES OF OPTICAL BRIGHTENERS AND THEIR USE FOR THE OPTICAL BRIGHTENING

CROSS-REFERENCE TO RELATED APPLICATION

This application is a continuation of Ser. No. 073,938 filed Sept. 10, 1979 and now abandoned.

The German patent application P 27 59 217.2 relates to mixtures of optical brighteners consisting of from 0.05 to 0.95 part by weight of a compound of the formula I

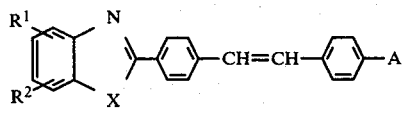

I and of from 0.95 to 0.05 part by weight of a compound of the formula II

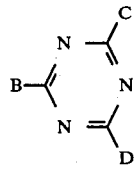

II in which the symbols X, $R^1$, $R^2$, A, B, C and D are defined as follows:

X is oxygen or sulfur, $R^1$ and $R^2$, which may be identical or different, are radicals selected from the group consisting of hydrogen, fluorine or chlorine atoms; phenyl, $C_{1-9}$alkyl, $C_{1-4}$alkoxy, $C_{1-4}$dialkylamino, acylamino groups or optionally functionally modified carboxy or sulfo groups, or two vicinal radicals $R^1$ and $R^2$, when taken together, stand for a benzo ring, for lower alkylene or 1,3-dioxapropylene; A is cyano, a group of the formula —$COOR^3$ or $CONR_2^3$ with $R^3$ being hydrogen, $C_{1-18}$alkyl, cycloalkyl, aryl, alkylaryl, halogenaryl, aralkyl, alkoxyalkyl, halogenalkyl, hydroxyalkyl, alkylaminoalkyl, carboxyalkyl or carboalkoxyalkyl, or two alkyl or alkylene radicals standing for $R^3$, when taken together with the nitrogen atom, being morpholino, piperidino or piperazino ring; or A is a group of the formula

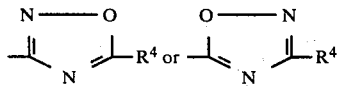

in which $R^4$ is straight chain or branched alkyl having from 1 to 10 carbon atoms, preferably 1 to 6 carbon atoms, which may be substituted by hydroxy, halogen, lower alkoxy, dialkylamino, lower alkylmercapto, chloroaryloxy, aryloxy, arylmercapto or aryl radicals both alkyl groups contained in the dialkylaminoalkyl groups, when taken together, standing optionally for a morpholino, piperidino or piperazino ring; or $R^4$ is a group of the formula —$(CH_2CH_2O)_n$—R with n being 1, 2 or 3 and R being hydrogen; lower alkyl, dialkylaminoalkoxyalkyl or alkylthioalkoxyalkyl, the alkyl groups in dialkylaminoalkoxyalkyl, when taken together, forming optionally a piperidino, pyrrolidino, hexamethylenimino, morpholino or piperazino ring; or $R^4$ is a group of the formula —$(CH_2)_m$—CH=CH—R with m being an integer of from 0 to 5, or $R^4$ is a radical of the formula

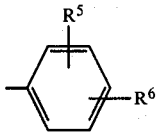

wherein $R^5$ and $R^6$, which may be the same or different, are radicals selected from the group consisting of hydrogen, fluorine or chlorine atoms, phenyl, lower alkyl, lower alkoxy, $C_{1-4}$acylamino groups or optionally modified carboxy or sulfo groups, two vicinal radicals $R^5$ and $R^6$, when taken together, standing optionally for lower alkylene, a fused benzo ring or 1,3-dioxapropylene;

B is a polycyclic aromatic radical having at least three condensed rings optionally carrying non chromophoric substituents;

C is amino, substituted by one or two alkyl, hydroxyalkyl, acyl or phenyl groups, the phenyl group containing optionally one or several non chromophoric radicals and two alkyl groups, when taken together with the nitrogen atom of the amino group forming optionally a pyrrolidino or piperidino ring or a piperazino or morpholino ring; or C is alkoxy, hydroxyalkyl, acyloxy, alkylthio or carbalkylmercapto;

D independant from C is defined as C and may further stand for a chlorine atom.

By further modifying this invention it has now been found that the brightening effect of these mixtures can be improved when adding to the above-described mixture a third component of the series of the bis-benzoxazolyl- or bis-benzothiazolyl-stilbenes.

Subject of the present invention, consequently, are mixtures of optical brighteners consisting of from (a) 0.98 to 0.50, preferably 0.98 to 70, in particular 0.98 to 0.90, part by weight of a mixture consisting of from 0.05 to 0.95 part by weight of a compound of formula I as defined above and of from 0.95 to 0.05 part by weight of a compound of formula II as defined above and of from (b) 0.02 to 0.50, preferably 0.02 to 0.30, particularly preferably 0.02 to 0.10, part by weight of a compound of formula III

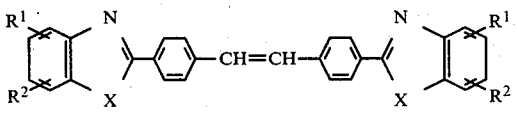

III wherein X, $R^1$ and $R^2$ are defined as in formula II.

Compounds of the formula I, wherein X, A, $R^1$ and $R^2$ are defined as above and $R^4$ stands for a member of the following group: $C_{1-6}$alkyl, $C_{1-6}$chloroalkyl, dimethyl- or diethylamino-$C_{1-4}$alkyl, morpholinoethyl, N-β-piperidinoethyl, N-β-(N'-methylpiperazino)-ethyl, benzyl, phenoxy-$C_{1-4}$alkyl, chlorphenoxy-$C_{1-4}$alkyl, $C_{1-4}$alkylmercapto-$C_{1-4}$-alkyl, phenylmercapto-$C_{1-4}$alkyl, phenyl, $C_{1-6}$alkylphenyl, di-$C_{1-6}$alkylphenyl, chlorphenyl, dichlorophenyl, $C_{1-6}$alkoxyphenyl, α- or β-naphthyl or a group of the formula —$(CH_2CH_2O)$-

$_n$—R with n being 1, 2 or 3 and R being hydrogen, $C_{1-7}$alkyl, $C_{1-4}$alkylmercapto-$C_{1-4}$alkyl, dimethyl- or diethylamino-$C_{1-4}$alkyl or morpholino-$C_{1-4}$alkyl, are particularly interesting.

Especially preferred are those compounds of the formula I wherein X is O or S, $R^1$ and $R^2$ in 6 or 7 position each are hydrogen or chlorine atoms, $C_{1-4}$alkyl, phenyl or, when taken together, a fused benzo ring and $R^4$ in the group A is $C_{1-6}$alkyl, $C_{1-6}$chloroalkyl, $C_{1-4}$alkoxy-$C_{1-4}$-alkyl, hydroxy-$C_{1-4}$alkyl or a group of the formula $—(CH_2CH_2O)_n—R'$ with n being 2 or 3 and R' being hydrogen or $C_{1-4}$alkyl.

Particularly interesting as a subgroup are further those compounds of the formula I wherein X is oxygen, $R^1$ in 5 position is hydrogen or chlorine, methyl or phenyl, $R^2$ is hydrogen or $R^1$ and $R^2$ each are a methyl group in 5,6 or 5,7 position and $R^4$ in the group A is methyl, ethyl, n- or iso-propyl, n- or isobutyl, pentyl, chloromethyl, β-chloroethyl, β-hydroxyethyl, β-methoxyethyl, β-ethoxyethyl, benzyl, phenyl, o-tolyl, 2,3-dimethylphenyl, o-chlorphenyl, p-chlorophenyl, 2,4-dichlorophenyl or p-methoxyphenyl.

Preferred compounds of formula III are those wherein $R^1$ and $R^2$ in the 5-, 6- and 7-position denote hydrogen or chlorine atoms, $C_{1-4}$alkyl or phenyl, particularly preferred are those compounds wherein $R^1$ in the 5-position denotes hydrogen or chlorine atom, methyl or phenyl, $R^2$ denotes hydrogen or $R^1$ and $R^2$ both denote methyl in the 5,6- or 5,7-position.

Especially preferred are those compounds of the formula II in which B is pyrene and C and D independant from each other are $C_{1-4}$alkoxy.

By the term "functionally modified carboxy group" there are to be understood carboxylic acid derivatives in the largest sense, i.e. compounds having one carbon atom, three bonds of which are occupied by hetero atoms, in particular oxygen, nitrogen and sulfur. In a narrow sense these compounds include salts with colorless kations, among which alkali metal or ammonium ions are preferred, and further the cyano group, a carboxylic acid ester group or a carbonamide group. Carboxylic acid ester groups include in particular those of the formula $COOQ^1$ wherein $Q^1$ is a phenyl radical or optionally branched $C_{1-4}$alkyl. Carbonamide groups include in particular those of the formula $CONQ^2Q^3$ wherein $Q^2$ and $Q^3$ each are hydrogen atoms or $C_{1-4}$, optionally substituted alkyl groups, which may form a hydroaromatic ring, when taken together with the nitrogen atom.

By the term "functionally modified sulfo groups" there are to be understood, in analogy to the above statements, radicals with a sulfo group linked to a hetero atom, i.e. salts with colorless kations, preferably alkali metal or ammonium ions, the sulfonic acid ester groups and the sulfonamide group. Sulfonic acid ester groups include in particular a group of the formula $SO_2OQ^1$ wherein $Q^1$ is defined as above and sulfonamide groups include those of the formula $SO_2NQ^2Q^3$ wherein $Q^2$ and $Q^3$ are defined as above.

Suitable acyl groups include in particular those of the formula $COQ^4$ wherein $Q^4$ is optionally substituted, preferably lower, alkyl or phenyl, in particular unsubstituted $C_{1-4}$alkanoyl or benzoyl. Preferred substituents for $R^3$ are $C_{1-6}$alkyl, halogenalkyl or alkoxy.

In addition to the above subgroups any other subgroups may be formed from the definitions for X, $R^1$, $R^2$, A, B, C and D. It is quite natural that it is not intended to introduce new matter according to 35 U.S.C. 132 by the formation of such new sub-groups.

Unless stated otherwise, alkyl groups and other groups derived therefrom, each have of from 1 to 4 carbon atoms.

The following radicals may stand for $R^1$ and $R^2$: methyl, ethyl, n- or isopropyl, n- or iso-butyl, pentyl, hexyl, methoxy, ethoxy, propoxy, butoxy, pentoxy, hexoxy, dimethylamino, diethylamino, trimethylammonium, triethylammonium, acetylamino, cyano, $—SO_3H$, carboxyl, carbomethoxy, -ethoxy-, -propoxy, -butoxy and the corresponding groups of the class of sulfonic acid alkyl esters, methyl-, ethyl-, propyl-, butyl-carbonamide, and the corresponding groups of the class of alkylsulfonamides and the corresponding dialkylcarbonamide groups or -sulfonamide groups. Two vicinal groups $R^1$ and $R^2$ may form thogether a fused benzo or cyclohexyl ring. Those compounds are preferred that contain the benzoxazolyl group (X=O).

$R^4$ may stand for the following groups: methyl, ethyl, n- or isopropyl, n- or iso-butyl, pentyl, hexyl or the chloroalkyl, hydroxyalkyl, dimethylaminoalkyl, diethylaminoalkyl, methoxyalkyl, ethoxyalkyl, propoxyalkyl, butoxyalkyl, methylenmercaptoalkyl, ethylmercaptoalkyl, chlorophenoxyalkyl, phenoxyalkyl, phenylmercaptoalkyl, phenylalkyl and naphthylalkyl groups which derive therefrom; $R^4$ may further stand for groups of the formula $(CH_2CH_2O)_nR$ with n being 1, 2 or 3 and R being hydrogen, methyl, ethyl, propyl or butyl, dimethyl- or diethylaminoalkoxyalkyl having from 1 to 4 carbon atoms in the alkyl or alkoxy moiety or those alkylthioalkoxyalkyl groups which have likewise of from 1 to 4 carbon atoms in the alkyl or alkoxy moieties. Examples of these radicals are those of the formulae $—CH_2CH_2OCH_3$, $—CH_2CH_2OC_2H_5$, $—CH_2CH_2OC_3H_7$, $—CH_2CH_2OC_4H_9$, $—CH_2CH_2OC_6H_{13}$,

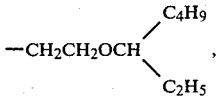

$—CH_2CH_2OC_6H_{11}$, $—(CH_2CH_2O)_2CH_3$, $—(CH_2CH_2O)_2C_2H_5$, $—(CH_2CH_2O)_2C_4H_9$, $—(CH_2CH_2O)_3C_2H_5$, $—CH_2CH_2OCH_2CH_2SC_2H_5$, $—CH_2CH_2OCH_2CH_2—N(CH_2)_2$, $—CH_2CH_2OCH_2CH_2—N(C_2H_5)_2$ or

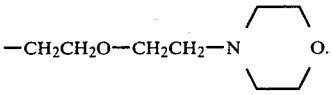

Alternatively $R^4$ may be unsubstituted phenyl or phenyl substituted once or twice, in which case the alkyl, alkoxy, acyl, carboalkoxy, alkylcarbonamido, alkylsulfonamido and sulfonic acid alkyl ester groups may have of from 1 to 4 carbon atoms. Two substituents $R^5$ and $R^6$ may also form together a fused benzo ring.

Suitable polycyclic aromatic radicals of the formula II are pyrene, anthracene, acenaphthene and chrysene radicals, preferably pyrene. Examples of alkyl, alkoxy or acyl groups are those which have of from 1 to 4 carbon atoms. As non chromophoric radicals there may be mentioned halogen, alkyl, alkoxy, mono- and dialkylamino, acylamino, cyano, sulfo, sulfoacid alkyl esters, carboxy, carboalkoxy, sulfonamido, carbonamido and the mono- and di-alkylamides derived therefrom, each alkyl, acyl or alkoxy group having 1-4 C-atoms.

The compounds of the formula I as far as they possess no oxadiazole ring, are known from the following Japanese patent applications: Sho 43-7045; Sho 44-6980; Sho 44-6981; Sho 44-6982 and Sho 42-21013.

The compounds of the formula I wherein A is an oxadiazole ring, may be prepared according to Belgian patent 852 278 by reacting a compound of the formula IV

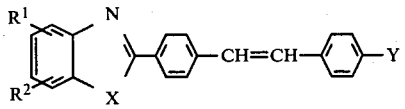

IV with a compound of the formula V

R—Z V wherein $R^1$, $R^2$, X and $R^4$ are defined as above and Y is a group of the formula VI

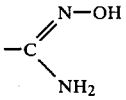

VI and Z is simultaneously a group of the formula VII

—COCl or Y is a group of the formula VII and Z is simultaneously a group of the formula VI.

In the first case there are obtained compounds of the formula I wich contain a 1,2,4-oxadiazolyl-3 group and in the second case the compounds obtained contain the 1,2,4-oxadiazolyl-5 group. The reaction occurs preferably in the presence of an acid binding agent in an inert solvent, at a temperature of from 20° to 200° C.

The starting compounds of the formula V wherein Z is a group of the formula VII, may be prepared according to the process disclosed in Chem. Rev. 62 (1962), pages 155 et seq.. The starting compounds of the formula IV wherein Y is a group of the formula VI may likewise be prepared in analogous manner according to this process.

The compounds of the formula II are known from DT-AS 1,273,479 and may be prepared according to the process disclosed in this publication.

The compounds of the formula III are known from the following patent specifications DE-AS 1,255,077; BE-PS 648,674; DE-AS 1,288,608; DE-AS 1,445,694 and DE-OS 1,469,207.

The reaction products obtained in the aforesaid processes may be subjected to further known conversions, for example those in which sulfo- or carboxy groups are funtionally modified or those in which sulfo- or carboxy groups are converted to provide other groups of this type or the free acids. Furthermore chloromethyl groups may be incorporated in known manner or methyl groups may be oxidized. In addition, the incorporated halogen atoms may be halogenated or subjected to further reactions, for example chlorine or bromine may be exchanged for the amine function.

The mixing ratio of the components I and II ranges between 0.05 and 0.95 part by weight of the compound I and the corresponding quantity (0.95 to 0.05 part by weight) of the compound II. The optimum mixing ratio depends in each case of the nature of the individual compounds of the formulae I and II and may be readily determined by preliminary tests. Component III is added to components I and II in the above-specified mixing ratios.

As is customary for optical brighteners, the individual components are brought into a commercial form by dispersion in a solvent, for example by dispersing them separately and by combining the dispersions. Alternatively the individual components can be mixed in substance and be dispersed together. Dispersing is effected in usual manner in ball mills, colloid mills, bead mills, or dispersion kneaders. The mixtures according to the invention are especially useful for brightening linear polyesters, polyamides and acetyl cellulose. However, they can likewise be used with the same good result in blended fabrics consisting of linear polyesters and other synthetic or natural fibers, especially hydroxyl groups-containing fibers, in particular cotton. These mixtures are applied onto the fibers under conditions that are customary for the application of optical brighteners, for example according to the exhaust process, at a temperature of from 90° to 130° C. with or without the addition of accelerators (carriers) or according to the thermosol process. Brighteners that are unsoluble in water and the mixtures according to the invention can alternatively be dissolved in organic solvents such as perchloroethylene prior to being used. In this operation the textile material may be treated with the solvent liquor that contains the optical brightener in a dissolved state according to the exhaust process. Another way consists in impregnating, padding or spraying the textile material with the solvent liquor that contains the brighteners and then drying the textile material at a temperature of from 120° to 220° C. to fix all optical brightener in the fiber.

An advantage of the use of the mixtures as described above resides in the fact that an unexpected synergistic effect as regards the degree of whiteness is achieved, i.e. a mixture of compounds of the formulae I, II and III gives a higher degree of whiteness than an identical quantity of only one of the compounds of the formulae I, II or III.

This signifies that the quantity of the mixture according to the invention which is required for achieving a defined degree of whiteness is smaller than that of the individual components.

The following examples illustrate the invention. Parts and percentages are by weight unless otherwise stated. The temperature is indicated in degrees Celsius. The degrees of whiteness have been measured according to the formulae of Stensby (Soap and Chemicals Specialities, April 1967, pages 411 et seq.) and Berger (Die Farbe, 8 (2959), pages 187 et seq.).

EXAMPLE 1

Tissu sections consisting of polyester staple fibers were washed and dried in usual manner before being impregnated on a padding mangle with an aqueous dispersion containing 0.5 g/l of a mixture consisting of 70 weight % of the compound of the formula

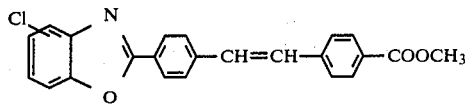

and of 30 weight % of the compound of the formula

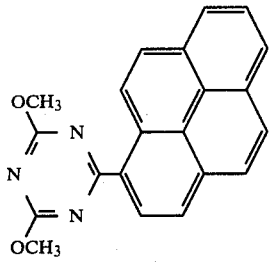

The material was squeezed with a padding mangle between rollers to an 80% liquor take-up which corresponds to a total take-up of optical brightener on the material of 0.04%. The padded material was then dried on a tenter frame for 30 seconds at 120° C. and thermosoled for a further 30 seconds at 190° C. to provide a degree of whiteness of 143 (Berger) and of 146 (Stensby).

When proceeding in the manner indicated above, but with the use of 0.45 g/l of the above-described brightener mixture and additionally 0.05 g/l of the brightener of the formula

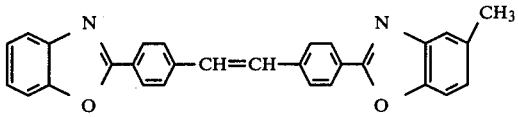

a significant improvement of the degree of whiteness can be observed. The degree of whiteness was found to be 146 (Berger) or 148.5 (Stenby).

EXAMPLE 2

Polyester curtains having a raschelle tulle binding were washed in usual manner in a continuous washing machine, then dried on a tender frame at 120° C. and impregnated on a padding mangle with an aqueous dispersion containing 0.5 g/l of a mixture consisting of 75 weight % of a compound of the formula

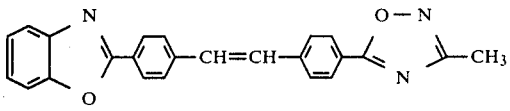

I and of 25 weight % of a compound of the formula

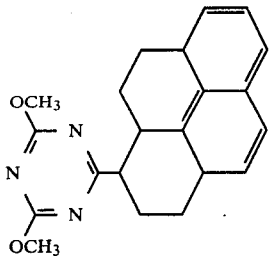

II

The material was then squeezed between rollers to yield a liquor absorption of 80%, which corresponds to a take-up of optical brightener on the material of 0.04%. The padded material was dried on a tenter frame for 30 seconds at 120° C. and thermofixed for a further 40 seconds at 180° C. The brightened goods were found to have the following degrees of whiteness: 145 (Berger) or 146 (Stenby).

When proceeding in the above manner but with the use of 0.47 g/l of the above-described brightener mixture and additionally 0.03 g/l of the brightener of the formula

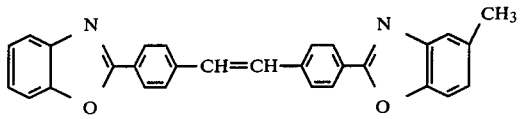

the degrees of whiteness were found to be 147 (Berger) and 149 (Stensby). This signifies that a significant improvement of the degree of whiteness can be reached with the addition of the third component.

What is claimed is:

1. Mixtures of optical brighteners consisting essentially of from (a) 0.98 to 0.50 part by weight of a mixture consisting essentially of from 0.05 to 0.95 part by weight of a compound of the formula I

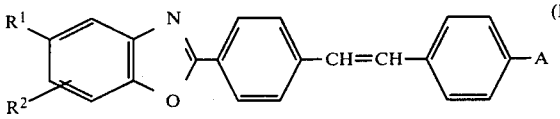

(I)

wherein $R^1$ is hydrogen or $C_1$–$C_4$ alkyl; $R^2$ is in the 6- or 7-position and is hydrogen or $C_1$–$C_4$ alkyl; and A is selected from the following formulas: —CN, —COOH, —$COOCH_3$,

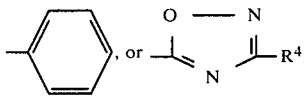

$R^4$ being $C_1$–$C_4$ alkyl or β-hydroxyethyl;

and of from 0.95 to 0.05 part by weight of a compound of the formula II (II)

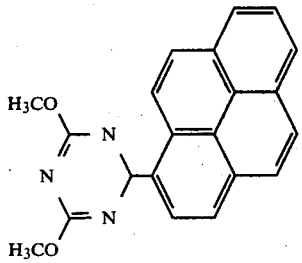

and of from (b) 0.02 to 0.5 parts by weight of a compound of the formula III (III)

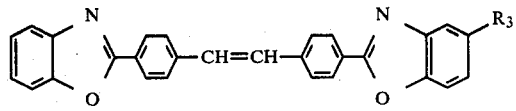

wherein $R_3$ is hydrogen or $C_1$–$C_4$-alkyl.

2. Mixtures according to claim 1 containing a compound of the formula I wherein $R^1$ and $R^2$ are hydrogen or methyl and A is as defined previously and $R^4$ is methyl, ethyl, or $\beta$-hydroxyethyl, and a compound formula of III wherein $R^3$ is hydrogen, methyl or butyl.

3. Mixtures according to claim 1, wherein $R^1$ and $R^2$ are each a methyl group.

4. Mixtures according to claim 1, wherein $R^1$ is methyl or hydrogen, and $R^2$ is hydrogen.

* * * * *